US008221140B2

(12) United States Patent
Schneider et al.

(10) Patent No.: US 8,221,140 B2
(45) Date of Patent: Jul. 17, 2012

(54) SPARK PLUG SOCKET

(75) Inventors: Michael Schneider, Rietheim-Weilheim (DE); Georg Maier, Kernen i. R. (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 12/890,611

(22) Filed: Sep. 25, 2010

(65) Prior Publication Data

US 2011/0086528 A1 Apr. 14, 2011

(30) Foreign Application Priority Data

Oct. 8, 2009 (DE) ..... 10 2009 048 801

(51) Int. Cl.
*H01R 13/44* (2006.01)

(52) U.S. Cl. ..... 439/125

(58) Field of Classification Search ..... 439/125–128, 439/34, 816, 890, 893, 130; 123/634–635
See application file for complete search history.

(56) References Cited

U.S. PATENT DOCUMENTS 2,690,541 A * 9/1954 Elliott ..... 439/125
3,354,419 A * 11/1967 Miller, Jr. ..... 439/125
2008/0274632 A1* 11/2008 Lenfert et al. ..... 439/125

FOREIGN PATENT DOCUMENTS

DE 195 15 623 A1 7/1996

* cited by examiner

*Primary Examiner* — Edwin A. Leon
(74) *Attorney, Agent, or Firm* — Gudrun E. Huckett

(57) ABSTRACT

A spark plug socket has an elastic base member and a contact element secured in the base member. The base member has a spark plug receptacle for a spark plug and the contact element has a contact receptacle for a terminal of the spark plug. The spark plug socket is removable in a removing direction from the spark plug. In an unloaded state of the spark plug socket arranged on the spark plug, a section of the contact receptacle engages behind the terminal of the spark plug in the removing direction of the spark plug socket. A longitudinal center axis of the contact receptacle is slanted relative to a longitudinal center axis of the spark plug receptacle. The contact element is adjustable against an elasticity of the base member such that an angle between the longitudinal center axis of the contact receptacle and the longitudinal center axis of the spark plug receptacle is reduced.

14 Claims, 2 Drawing Sheets

SPARK PLUG SOCKET

BACKGROUND OF THE INVENTION

The invention relates to a spark plug socket for a spark plug wherein the spark plug socket comprises an elastic base member and a contact element secured in the base member. The base member has a spark plug receptacle for the spark plug and the contact element has a contact receptacle for a connecting contact of the spark plug. The spark plug socket can be removed or pulled off in a direction of removal from the spark plug. In an unloaded state of the spark plug socket arranged on the spark plug a section of the contact receptacle engages behind the connecting contact of the spark plug viewed in the removing direction of the spark plug socket.

DE 195 15 623 A1 discloses a spark plug socket whose contact element is comprised of a wound wire. It has been found that in case of such spark plug sockets mounting can be difficult when unfavorable tolerances of the connecting contact of the spark plug and of the contact element coincide. Also, it may happen that the spark plug socket after first installation is not seated fixedly when play exists between the contact element and the terminal as a result of tolerances. This leads to increased expenditure for manufacture because either the tolerances are to be selected to be very narrow or matching tolerance pairs must be selected.

SUMMARY OF THE INVENTION

It is an object of the present invention to provide a spark plug socket for a spark plug of the aforementioned kind that even for unfavorable tolerances can be mounted in a simple way and that is secured safely on the spark plug.

In accordance with the present invention, this is achieved in that the longitudinal center axis of the contact receptacle relative to the longitudinal center axis of the spark plug socket is positioned at a slant and that the contact element is adjustable against the elasticity of the base member such that the angle between the longitudinal center axis of the contact receptacle and the longitudinal center axis of the spark plug receptacle decreases.

Since the contact receptacle engages the terminal from behind, a positive-locking fixation of the spark plug socket is provided. Even for a clearance fit between contact receptacle and terminal, a safe fixation of the spark plug socket can be ensured in this way. A simple configuration is provided in that the longitudinal center axis of the contact receptacle is slanted relative to the longitudinal center axis of the spark plug receptacle. As a result of the slant, in a simple way an engagement can be realized by slanted positioning of the contact receptacle so that a simple configuration is provided. Simple mounting and demounting of the spark plug socket is achieved in that the contact element is adjustable against the elasticity of the base member such that the angle between the longitudinal center axis of the contact receptacle and the longitudinal center axis of the spark plug receptacle decreases. In this way, the contact receptacle is adjusted such that no or only minimal engagement is provided. In this way, the contact element for mounting and demounting must not be elastically deformed but only the base member that is made of an elastic material anyway. Because of the elasticity of the base member it is also ensured that the spark plug socket is safely secured on the spark plug in a deactivated state because in this state an engagement of the terminal is provided.

The removing direction extends in particular in the direction of the longitudinal center axis of the spark plug receptacle. The tolerances of contact receptacle and terminal can be designed such that no press fit can be realized so that the spark plug socket is always mountable easily. In order to enable large tolerances and to thus enable a simple manufacture, it is however also possible to employ press fit.

The angle between the longitudinal center axes is in particular between approximately 10° and approximately 35°. Advantageously, the angle is between approximately 15° and approximately 25°. Especially advantageous is an angle of approximately 20°.

Advantageously, the terminal is of a barrel shape and has a greatest cross-section that is engaged by the contact receptacle. The contact receptacle is advantageously approximately cylindrical. In this connection, a smooth surface of the contact receptacle must not be provided but instead a structured surface can be provided as it is formed, for example, when the contact receptacle is made from a wound wire.

Advantageously, the contact element has an outwardly projecting leg relative to the longitudinal center axis of the contact receptacle. The base member has advantageously a cable receptacle into which the leg projects and on which the leg is supported. In this connection, the leg can also be supported by means of its entire topside on the cable receptacle. However, it can also be provided that the leg is supported only on individual points of the cable receptacle. The support on the cable receptacle ensures a defined slanted positioning of the contact receptacle. A simple configuration results when the leg has one end that electrically contacts an ignition wire received in the cable receptacle.

Advantageously, the contact receptacle is slanted away from the leg on the side facing away from the spark plug. When mounting the spark plug socket, usually the cable receptacle is gripped and pushed downwardly. By applying pressure in this area, the contact receptacle is erected and the slant angle of the slanted position of the contact receptacle is reduced so that the contact receptacle can be pushed easily across the terminal. When the cable receptacle is released after mounting of the spark plug socket, the contact receptacle, because of the elasticity of the base member, will assume a slanted position and engages thus the terminal so that a positive-locking securing action of the spark plug socket on the spark plug is achieved.

Advantageously, the contact receptacle is shape-stable with respect to the forces that act when removing (pulling off) and pushing on the spark plug socket. In this way, the contact receptacle can be designed to be of satisfactory stability. Since the fixation of the contact receptacle is not force-locking (frictional) but positive-locking and the contact receptacle upon pushing on and removing (pulling off) the spark plug socket is moved in a straight position, a deformation of the contact receptacle is not required.

A simple configuration results when the contact element is comprised of spring wire. The base member of the spark plug socket is comprised in particular of rubber, preferably silicone.

DESCRIPTION OF THE PREFERRED EMBODIMENTS

Figure 1:
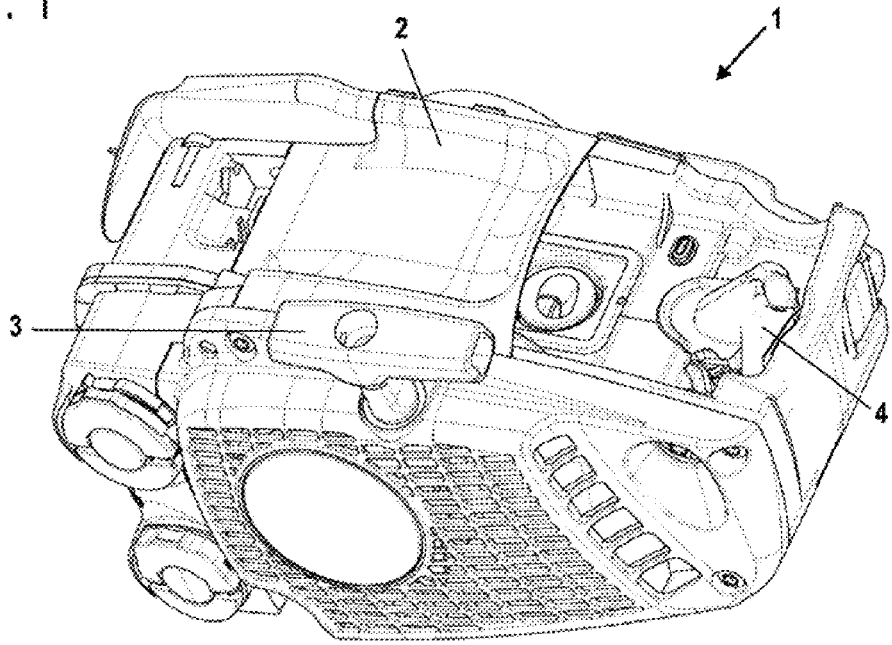
FIG. 1 is a perspective illustration of a power tool.

FIG. 1 is an embodiment of a power tool 1 in the form of a hand-held motor chainsaw. However, the proposed spark plug socket can also be employed with advantage in other devices, in particular in hand-head power tools such as cut-off machines, trimmers, lawnmowers or the like. The power tool 1 has a housing 2 from which a cable pull handle 3 projects. The rearward area of the housing 2 is shown open. Here a spark plug socket 4 of an internal combustion engine, not shown in FIG. 1, is illustrated. The cable pull handle 3 serves for starting the internal combustion engine.

Figure 2:
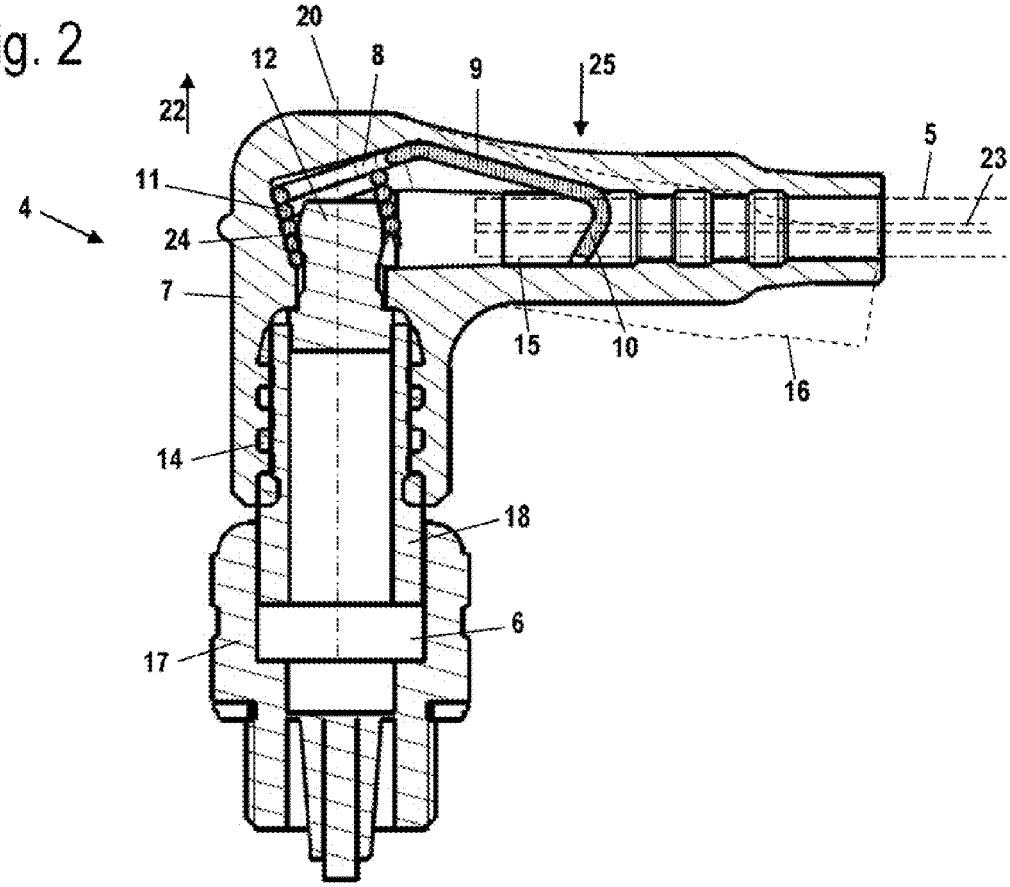
FIG. 2 is a section view of an embodiment of a spark plug socket positioned on a spark plug.

FIG. 2 shows the arrangement of the spark plug socket 4 positioned on a spark plug 6. An ignition cable 5 with a conductor 23 extends away from the spark plug socket 4 and is connected to an ignition device of the internal combustion engine. Through the ignition cable 5 the spark plug 6 is supplied with ignition energy. The ignition cable 5 projects into a cable receptacle 15 of the spark plug socket 4. The cable receptacle 15 is designed as an opening or bore in a base member 7 of the spark plug socket 4. The base member 7 of the spark plug socket 4 is comprised of elastic material, for example, rubber, in particular caoutchouc or silicone rubber. The base member 7 is approximately of an L-shaped (right angle) configuration. In the second leg of the base member 7 a spark plug receptacle 14 is formed in which the spark plug 6 is secured. The spark plug 6 has a housing 17 and an insulator 18 that projects into the spark plug receptacle 14. At the upper end of the insulator 18 there is a terminal 12 that is approximately barrel-shaped. The spark plug receptacle 14 has a longitudinal center axis 20 that coincides with the symmetry axis of the barrel-shaped terminal 12.

In the base member 7 a contact element 8 is arranged that is comprised of a wound wire, for example, a spring wire. The contact element 8 has a contact receptacle 11 for the terminal 12 of the spark plug 6. The contact receptacle 11 is comprised of several tightly wound wire windings. The contact receptacle 11 is substantially cylindrical. From the contact receptacle 11 a leg 9 projects outwardly that is of an angled configuration. In the embodiment according to FIG. 2, the leg 9, with a side that is facing away from the spark plug 6, rests across its entire length against the base member 7 of the spark plug socket 4 and is supported on the base member 7. The contact receptacle 11 of the contact element 8 is arranged in a cylindrical receptacle 24 of the base member 7. The contact element 8 is not embedded by injection molding in the material of the base member 7 but the base member 7 is tightly contacting the contact element 8 in the area of the receptacle 24 and rests tightly on the leg 9.

The leg 9 has a free end 10 that contacts the conductor 23. The ignition cable 5 is secured in a cable receptacle 15 of the base member 7 that communicates with the receptacle 24 of the contact element 8. The leg 9 is arranged in the cable receptacle 15.

Figure 3:
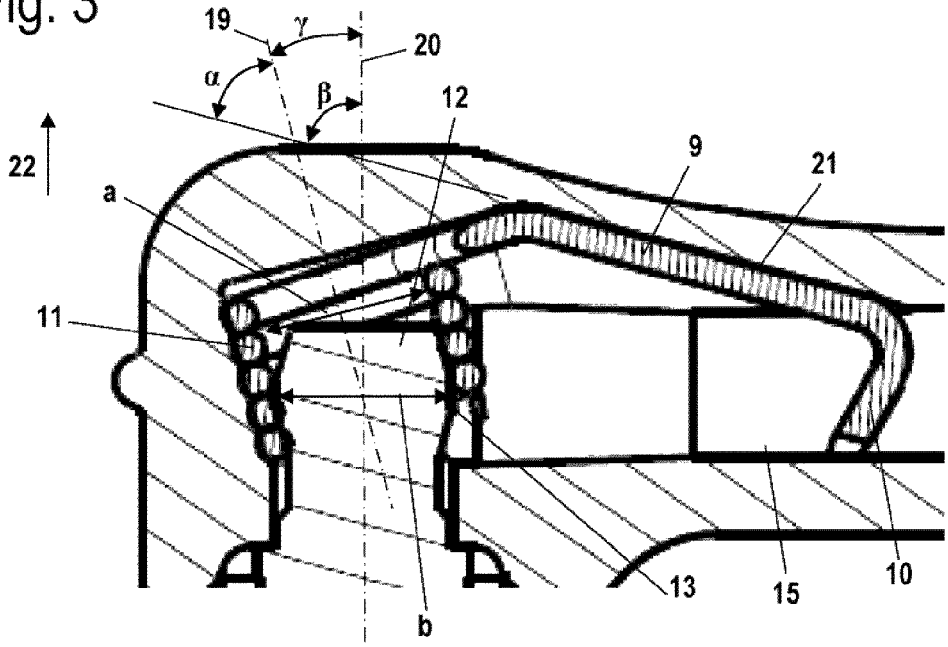
FIG. 3 is a the detail view of the terminal of FIG. 2.

As shown in FIG. 3, the contact receptacle 11 has a longitudinal center axis 19 that, relative to the contact surface 21 of the leg 9 contacting the base member 7, defines an angle $\alpha$. The longitudinal center axis 20 of the ignition receptacle 14. that coincides with longitudinal center axis of the terminal 12 is positioned relative to the contact surface 21 at an angle $\beta$ that is greater than the angle $\alpha$. The longitudinal center axes 19 and 20 define an angle $\gamma$ that is approximately 10° to approximately 35°.

In particular, the angle $\gamma$ is approximately 15° to approximately 25°. Especially advantageous is an angle $\gamma$ of approximately 20°. The angle $\gamma$ can advantageously correspond to the slant of the barrel-shaped outer side of the terminal 12. The terminal 12 has a greatest cross-section 13 that has a greatest diameter b. The contact receptacle 11 has an inner diameter a that advantageously matches minimally the greatest diameter b of the terminal 12. In this way, the contact receptacle 11 can be pushed simply onto the terminal 12 and removed therefrom (pulled off) when the contact element 8 is pivoted such that the longitudinal center axes 19 and 20 are approximately congruent.

The spark plug socket 4 can be pulled off the spark plug 6 in removing direction 22. In this direction, the contact receptacle 11 engages the greatest cross-section 13 of the terminal 12 in the unloaded state so that the spark plug socket 4 is positive-lockingly secured on the spark plug 6. In order to be able to mount the spark plug socket 4 on the spark plug 6, the contact element 8 must therefore be aligned such that the angle y between the longitudinal center axes 19 and 20 is reduced. This can be realized, as indicated in FIG. 2 by the arrow 25, by pressure applied on the cable receptacle 15. Since the leg 9 projects into the cable receptacle 15, the contact element 8 is erected by the pressure on the cable receptacle 15 with elastic deformation of the base member 7. The elastic deformation of the spark plug socket 4 is indicated in FIG. 2 by the contour 16 indicated in dashed lines. Upon this deformation, the contact receptacle 11 in the receptacle 24 of the base member 7 is erected also. Therefore, the contact receptacle 11 hardly engages or no longer engages the terminal 12 so that the spark plug socket 4 in removing direction 22 can be pulled off. Accordingly, the base member 7 when mounting the spark plug socket 4 is deformed by pressure in direction of arrow 25 so that a simple push-on action and a simple pull-off action of the spark plug socket 4 on a spark plug 6 are realized. As a result of the elasticity of the base member 7 the cable receptacle 15 is aligned perpendicularly to the longitudinal center axis 20 of the receptacle 14 as soon as the base member 7 in the area of the cable receptacle 15 is no longer actuated. In this way a safe securing action of the spark plug socket 4 is ensured.

Figure 4:
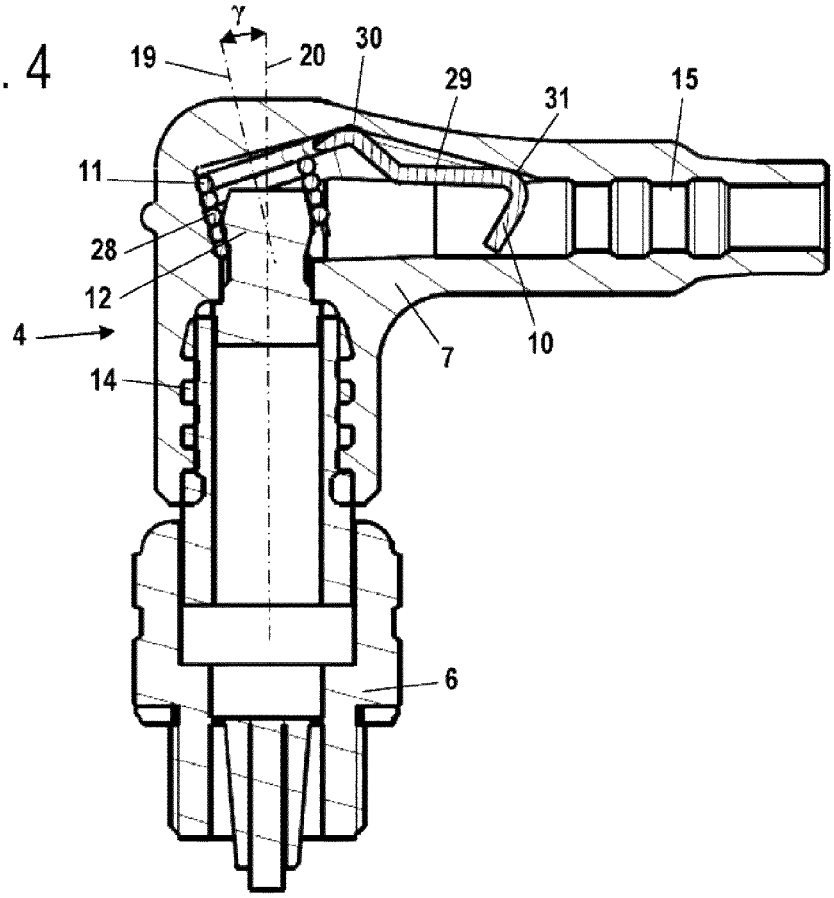
FIG. 4 is a section illustration of another embodiment of a spark plug socket positioned on a spark plug.

FIG. 4 shows an embodiment of a spark plug socket 4 that has a contact element 28. The spark plug socket 4 of FIG. 4 corresponds substantially to the spark plug socket 4 illustrated in FIGS. 2 and 3. Same reference numerals indicate elements that correspond to one another. The contact element 28 has a contact receptacle 11 with a longitudinal center axis 19 that is slanted relative to the longitudinal center axis 20 of the spark plug receptacle 14 by an angle $\gamma$ that corresponds to the angle $\gamma$ in FIG. 3. The contact element 28 has a leg 29 that is also projecting away from the contact receptacle 11 outwardly and that is of an angled configuration. The leg 29 is not supported across its entire length on the base member 7 of the spark plug socket 4 but contacts a first contact point 30 that is positioned adjacent to the contact receptacle 11 and a second contact point 31 where the end 10 of the contact element 28 is bent. By means of the two contact points 30 and 31 the position of the contact element 28 can also be secured. By pressure on the cable receptacle 15 the base member 7 of the spark plug socket 4 is deformed and the contact element 28 is pivoted such that the contact receptacle 11 will become erect and the angle $\gamma$ between the longitudinal center axes 19 and 20 becomes smaller. In particular, the angle $\gamma$ becomes approximately 0° so that the contact receptacle 11 is oriented parallel to the terminal 12 and the spark plug socket 4 can be pushed simply onto the spark plug 6 or can be pulled off.

In the illustrated embodiments the contact receptacle 11 is slanted on the side facing away from the spark plug 6 away from the leg 9, 29. However, a slant in the opposite direction may be advantageous also so that the contact element 8, 28 when pulling on the cable receptacle 15 in a direction opposite to the arrow 25 (FIG. 2) can be released from the terminal 12 or can be pushed on.

The specification incorporates by reference the entire disclosure of German priority document 102009048801.4 having a filing date of Oct. 8, 2009.

While specific embodiments of the invention have been shown and described in detail to illustrate the inventive principles, it will be understood that the invention may be embodied otherwise without departing from such principles.

What is claimed is:

1. A spark plug socket for a spark plug, the spark plug socket comprising:

an elastic base member;

a contact element secured in the base member;

wherein the base member comprises a spark plug receptacle for a spark plug and the contact element has a contact receptacle for a terminal of the spark plug, wherein the spark plug socket is removable in a removing direction from the spark plug;

wherein, in an unloaded state of the spark plug socket arranged on the spark plug, a section of the contact receptacle engages behind the terminal of the spark plug, viewed in the removing direction of the spark plug socket;

wherein a longitudinal center axis of the contact receptacle is slanted relative to a longitudinal center axis of the spark plug receptacle;

wherein the contact element is adjustable against an elasticity of the base member such that an angle between the longitudinal center axis of the contact receptacle and the longitudinal center axis of the spark plug receptacle is reduced.

2. The spark plug socket according to claim 1, wherein the removing direction extends in a direction of the longitudinal center axis of the spark plug receptacle.

3. The spark plug socket according to claim 1, wherein an inner diameter of the contact receptacle matches at least a greatest diameter of the terminal.

4. The spark plug socket according to claim 1, wherein the angle between the longitudinal center axis of the contact receptacle and the longitudinal center axis of the spark plug receptacle is approximately 10° to approximately 35°.

5. The spark plug socket according to claim 1, wherein the terminal has a barrel shape and has a greatest cross-section that is engaged from behind by the contact receptacle.

6. The spark plug socket according to claim 1, wherein the contact receptacle is cylindrical.

7. The spark plug socket according to claim 1, wherein the contact element has a leg that, relative to the longitudinal center axis of the contact receptacle, projects outwardly.

8. The spark plug socket according to claim 1, wherein the base member has a cable receptacle into which the leg projects, wherein the leg is supported on the cable receptacle.

9. The spark plug socket according to claim 8, wherein the leg has an end that electrically contacts an ignition cable arranged in the cable receptacle.

10. The spark plug socket according to claim 7, wherein the contact receptacle on a side facing away from the spark plug is slanted away from the leg.

11. The spark plug socket according to claim 1, wherein the contact receptacle is shape-stable with respect to forces acting upon pulling off and pushing on the spark plug socket onto the spark plug.

12. The spark plug socket according to claim 1, wherein the contact element is comprised of spring wire.

13. The spark plug socket according to claim 1, wherein the base member of the spark plug socket consists of rubber.

14. The spark plug socket according to claim 1, wherein the base member of the spark plug socket consists of silicone.

* * * * *